US006140597A

United States Patent [19]

Ichioka et al.

[11] Patent Number: 6,140,597

[45] Date of Patent: Oct. 31, 2000

[54] BREAKER DEVICE HAVING AN INCOMPLETE-CONNECTION PREVENTION FUNCTION

[75] Inventors: Tetsuo Ichioka; Sho Miyazaki, both of Nagoya, Japan

[73] Assignees: Harness System Technologies Research, Ltd., Aichi; Sumitomo Wiring Systems, Ltd., Mie; Sumitomo Electric Industries, Ltd., Osaka, all of Japan

[21] Appl. No.: 09/143,512

[22] Filed: Aug. 28, 1998

[30] Foreign Application Priority Data

Sep. 4, 1997 [JP] Japan ..... 9-239952
Oct. 17, 1997 [JP] Japan ..... 9-285499

[51] Int. Cl.[7] ..... H01H 21/84

[52] U.S. Cl. ..... 200/557; 200/16 R; 200/462

[58] Field of Search ..... 200/6 R–6 C, 200/16 R–16 D, 402, 431, 433, 432, 434, 435, 436, 437, 438, 439, 449, 462–467, 553, 557, 561–563, 332, 335, 4, 17 R

[56] References Cited

U.S. PATENT DOCUMENTS 1,465,412 8/1923 Bissell et al. ..... 200/468
1,781,710 11/1930 Stevens et al. ..... 200/464
2,028,314 1/1936 Brown ..... 200/51
2,467,797 4/1949 Wise ..... 200/116
2,473,263 6/1949 Smith ..... 200/6
3,483,490 12/1969 Hurtle ..... 335/6

FOREIGN PATENT DOCUMENTS 0 848 398 A1 6/1998 European Pat. Off. ..... H01H 1/46
0 848 399 A1 6/1998 European Pat. Off. ..... H01H 3/20
530622 12/1940 United Kingdom .

*Primary Examiner*—Michael Friedhofer
*Attorney, Agent, or Firm*—Oliff & Berridge, PLC

[57] ABSTRACT

A breaker device having tension coil springs that, while moving together with a moving electrode, are extended and contracted, and the resilient restoring force of these springs becomes maximum halfway along a path of movement thereof. When the moving electrode is disposed on the connection side of this maximum position, the tension coil springs urge the moving electrode in a connecting direction. When the moving electrode is disposed on the disconnection side, the tension coil springs urge the moving electrode in a disconnecting direction. When the moving electrode is in a properly-connected condition or a completely-disconnected condition, the urging force of the tension coil springs is decreased. A lock for holding the moving electrode in either the connected condition or the disconnected condition may also be provided.

15 Claims, 12 Drawing Sheets

BREAKER DEVICE HAVING AN INCOMPLETE-CONNECTION PREVENTION FUNCTION

BACKGROUND OF THE INVENTION

1. Field of the Invention

This invention relates to a breaker device having an incomplete-connection prevention function.

The present application is based on Japanese Application Nos. Hei. 9-239952 and 9-285499, which are incorporated herein by reference.

2. Description of the Related Art

FIGS. 1 and 2 show one known breaker device having an incomplete-connection prevention function. This breaker device comprises a pair of fixed electrodes 2 and 3, a moving electrode 4, a lever 5, a torsion coil spring 6, and a lock portion 7. The pair of fixed electrodes 2 and 3 is provided in a housing 1, and the two electrodes 2 and 3 are in opposing relation to each other. The moving electrode 4 is slidable between a position where it connects the two fixed electrodes 2 and 3 together and a position where it disconnects the two fixed electrodes from each other. The lever 5 is tiltably supported on the housing 1, and is connected to the moving electrode 4. The torsion coil spring 6 urges the lever 5 in a disconnecting direction. The lock portion 7 locks the lever 5 in the connected position.

In this breaker device, when an incompletely-connected condition is encountered, the lever 5 is forcibly displaced in the disconnecting direction by the bias of the torsion coil spring 6, thereby preventing the fixed electrodes 2 and 3 from being kept in the incompletely-connected condition. When the two electrodes 2 and 3 are properly connected together, the lever 5 is retained by the lock portion 7, and therefore is held in the connected position against the bias of the torsion coil spring 6, thereby locking the two fixed electrodes 2 and 3 in the properly-connected condition.

In the above known breaker device, the torsion coil spring 6 is used as means for urging the lever 5 in the disconnecting direction. One arm 6A of this spring extends along and is held against a lower surface of the housing 1, while the other arm 6*b* is engaged with the lever 5 along the length of this lever.

This torsion coil spring 6 is resiliently deformed or bent in such a manner that the angle between the two arms 6A and 6B is reduced, and the lever 5 is urged in the disconnecting direction by a resilient restoring force thereof.

The amount of resilient bending of the torsion coil spring 6 (i.e., the urging force in the disconnecting direction) gradually increases as the lever 5 is tilted in the connecting direction. When the lever 5 is locked in the proper connected position, the amount of resilient bending of the torsion coil spring 6 (i.e., the urging force) is at a maximum. The breaker device is usually kept locked in the properly-connected condition. Therefore, a condition in which the torsion coil spring 6 is much resiliently bent, and a condition in which a large stress is exerted on the lock portion 7 and the lever 5 by the bias of the torsion coil spring 6, lasts a long time. As a result, there are possibilities that the torsion coil spring 6 has a permanent set in fatigue and that a creep develops in the lock portion 7 or the lever 5.

Further, the breaker device is usually kept locked in the properly-connected condition, and therefore the lock portion 7 needs to have sufficient strength to lock the lever 5 in the connected position against the bias of the torsion coil spring 6. This required strength results in a drawback in that the lock portion 7 must have a large size. Another problem is that when the locking position is released due to an impact or vibration, the lever 5 is accidentally moved in the disconnecting direction by the bias of the torsion coil spring 6, so that the fixed electrodes 2 and 3 are disconnected from each other.

SUMMARY OF THE INVENTION

It is an object of the present invention to overcome the above-described problems. That is, it is an object of the invention to reduce the amount of resilient deformation of an incomplete-connection prevention spring member in a condition in which electrodes are connected together. It is also an object of the present invention to reduce the urging force of an incomplete-connection prevention spring member in a condition in which electrodes are connected together.

According to a first aspect of the invention, there is provided a breaker device comprising a lever and a spring member. The lever is tiltingly displaceable so as to connect a pair of electrodes together and to disconnect them from each other. The spring member urges the lever in a disconnecting direction when the pair of electrodes is in an incompletely-connected condition. When an operation for connecting the pair of electrodes together proceeds to a predetermined degree, the direction of urging of the lever by the spring member is switched to the connecting direction. Also an urging force of the spring member is decreased in accordance with the tilting movement of the lever in the connecting direction.

Before the operation for connecting the pair of electrodes together proceeds to the predetermined degree, the lever is tilted in the disconnecting direction by the bias of the spring member, and the two electrodes are forcibly spaced apart from each other. When the connecting operation proceeds to the predetermined degree, the direction of urging by the spring member is switched from the disconnecting direction to the connecting direction, and the two electrodes are forcibly connected together. Thus, the two electrodes are prevented by the bias of the spring member from being kept in an incompletely connected condition.

The amount of resilient deformation of the spring member becomes maximum halfway during the connecting operation when the direction of urging by the spring member is switched from the disconnecting direction to the connecting direction. In the condition in which the two electrodes are properly connected together, and the two electrodes are completely disconnected from each other, the amount of resilient deformation of the spring member is reduced. Therefore, a permanent set in fatigue is prevented from developing in the spring member, and also a creep due to the bias of the spring member is prevented from developing in the parts.

According to a second aspect of the present invention, a tilting pivot of the lever is displaceable in the same directions as the directions of connection and disconnection of the electrodes.

The tilting pivot of the lever is displaced in the directions of connection and disconnection of the electrodes, and therefore as compared with a construction in which a lever is tilted about a fixed pivot, the lever is tilted at a larger angle in the connected position and the disconnected position. Therefore, the size of the device in the direction of its height can be reduced.

According to a third aspect of the present invention, when the lever is located at a starting end and a finishing end of the tilting movement thereof, the spring member is in a free condition in which the spring member is not resiliently deformed.

When the lever is not in the process of tilting movement, the lever is located at the starting end or the finishing end of the tilting movement. In this condition the spring member is not resiliently deformed. Therefore, the spring member does not produce any urging force, and therefore any stress due to the bias of the spring member will not develop.

According to a fourth aspect of the present invention, there is provided a breaker device comprising a moving electrode, a guide, and a spring member. The moving electrode is movable in both the connecting and disconnecting directions relative to a fixed electrode. The guide extends in slanting relation to a direction of movement of the moving electrode. The spring member is movable in the connecting and disconnecting directions together with the moving electrode. The guide guides the spring member so as to be extend and contract the spring member. A resilient restoring force of the spring member becomes maximum halfway along a path of movement of the moving electrode, and using the maximum position as the border, the spring member urges the moving electrode in either the connecting direction or the disconnecting direction.

When the moving electrode is moved in the connecting direction, the moving electrode is urged in the disconnecting direction halfway in this connecting process. Therefore, if the connecting operation is interrupted halfway through the operation, the moving electrode is returned in the disconnecting direction. When the moving electrode moves past the position where the resilient restoring force of the spring member is at a maximum, the direction of urging of the moving electrode is switched from the disconnecting direction to the connecting direction. As a result, the moving electrode is positively connected to the fixed electrode. Namely, the two electrodes are prevented by the bias of the spring member from being kept in an incompletely connected condition. The urging force of the spring member is decreased in the connected condition and the disconnected condition, and therefore it is not necessary to increase the strength and size of a lock means which can hold the moving electrode in these positions. In the case where there is provided means for locking the moving electrode in the connected condition, the moving electrode is prevented from being moved in the disconnecting direction even if this locking is accidentally released.

According to a fifth aspect of the present invention, an urging force is applied by the spring member to the moving electrode even when the moving electrode is moved to the connected position to be connected to the fixed electrode.

The moving electrode is kept urged in the connected direction even when the moving electrode is connected to the fixed electrode, and therefore even if a small external force is applied in the disconnecting direction, the moving electrode is held in the connected condition, and the connection is reliability high.

According to a sixth aspect of the present invention, the spring member comprises a tension coil spring, and therefore the spring member will not be buckled, in contrast with the case where the spring member comprises a compression coil spring. Namely, the function of urging the moving electrode is highly reliable.

DETAILED DESCRIPTION OF THE PREFERRED EMBODIMENTS

[First Embodiment]

Figure 1:
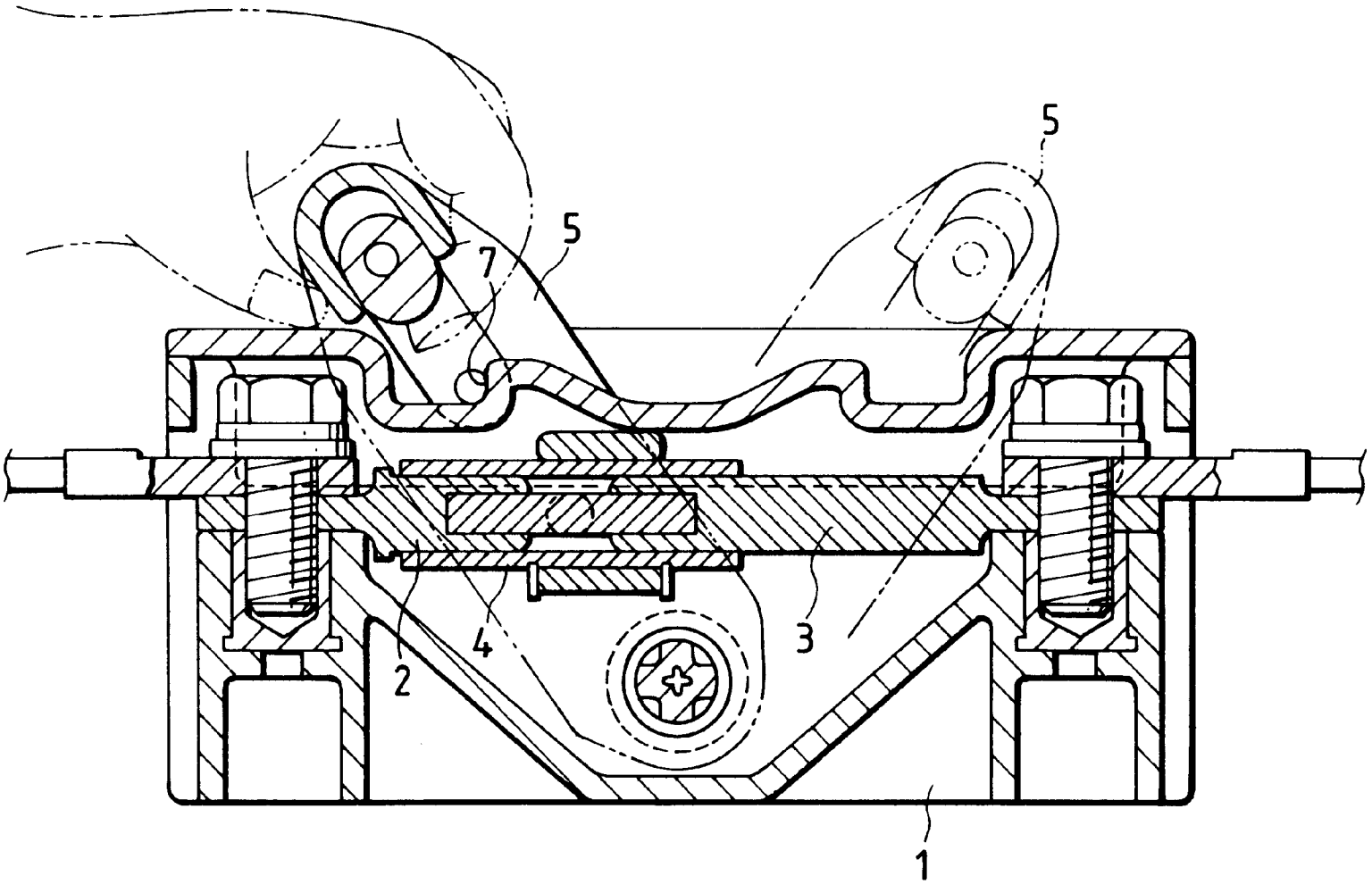
FIG. 1 (Prior Art)
FIG. 1 is a vertical cross-sectional view of a breaker device of known construction, showing the tilting movement of a lever.
Figure 2:
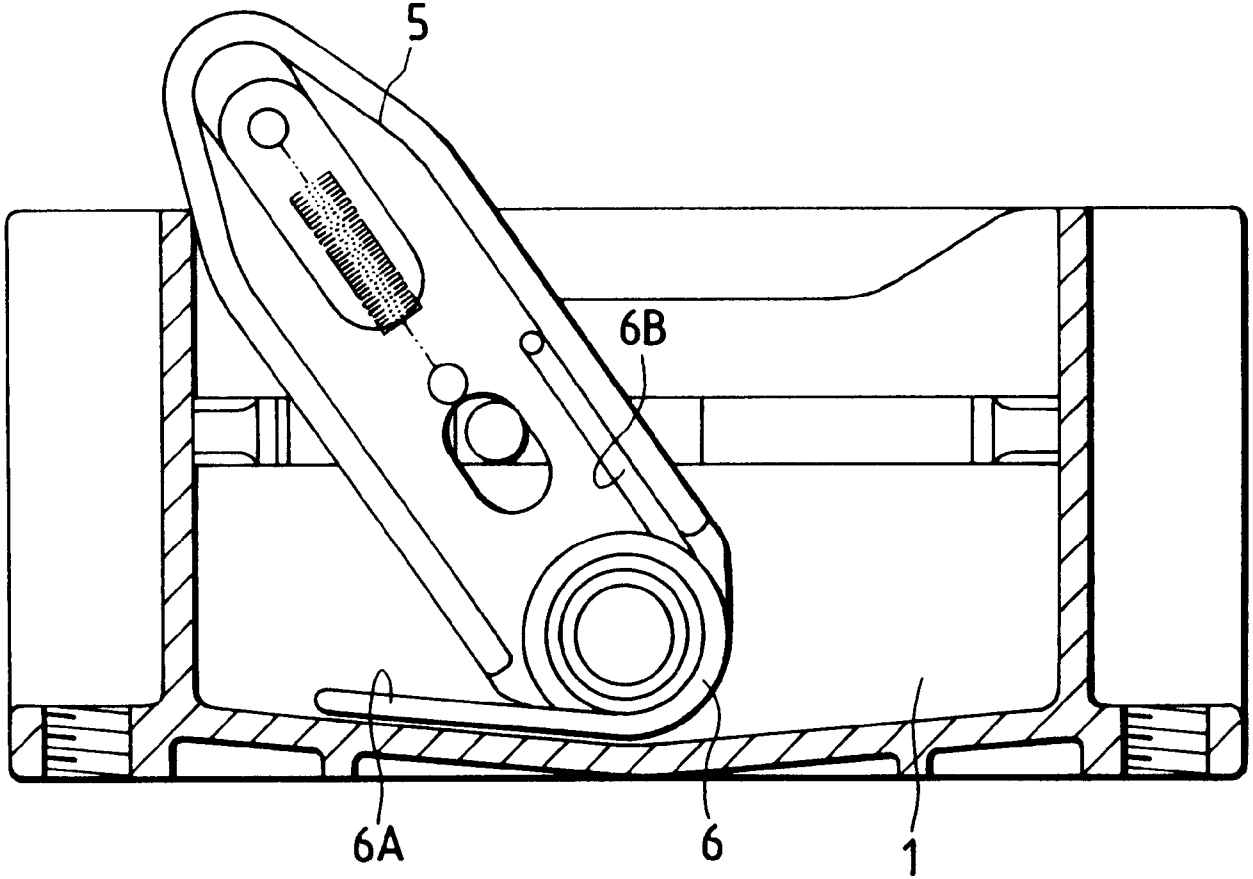
FIG. 2 (Prior Art)
FIG. 2 is a partly broken, side-elevational view of the breaker device of known construction, showing a spring member.

A preferred embodiment of the present invention will now be described with reference to FIGS. 3 to 7.

A breaker device of this embodiment is provided for opening and closing a main power circuit connecting a battery (not shown) to various electronic equipment in an electric car. An electrode unit 20, which is received in a casing 10 made of synthetic resin, is brought into a fitted condition and a disengaged condition by pivotally moving a lever 35.

The casing 10 comprises a casing body 11 of a rectangular parallelepiped shape with an open top, and a panel 12 attached to the casing body 11 to close this open top. The casing 10 is fixedly mounted in a vehicle body of the electric car through leg portions 13 (see FIG. 5) provided respectively at four corner portions of the casing body 11. The interior of the casing body 11 is divided into three chambers by two partition walls (see FIG. 5). The intermediate chamber serves as an electrode receiving space 14 for receiving the electrode unit 20. The front and rear chambers serve as lever support spaces 15 for supporting the lever 35.

The electrode unit 20 includes a pair of left and right fixed electrodes 21L and 21R (electrodes that are constituent elements of the present invention) one of which is longer than the other, and a moving electrode 21M slidably fitted on the outer peripheries of these fixed electrodes. The two fixed electrodes 21L and 21R are each in the form of a round rod, and their distal ends are opposed to each other. The two fixed electrodes 21L and 21R are interconnected by a connecting rod 22 of a non-electrically-conductive synthetic resin, and therefore are integrally connected together, and are insulatingly spaced a predetermined distance from each other on a common axis extending in a right-left direction. The fixed electrode 21L, together with a connection terminal 24T (connected to an electric equipment-side cable 24C) is fixedly secured by a bolt 26 to a nut 25 that is insert-molded in the casing body 11. The fixed electrode 21R, together with a connection terminal 23T (connected to a battery-side cable 23C) is fixedly secured by a bolt 26 to a nut 25 that is insert-molded in the casing body 11.

The moving electrode 21M has such a cylindrical shape so that it can fit on the two fixed electrodes 21L and 21R, and a louver contact (not shown) is mounted on an inner peripheral surface of the moving electrode 21M. The moving electrode 21M is slidable between a connected position (see FIG. 3) where it is fitted on the two fixed electrodes 21L and 21R to interconnect them, and a disconnected position (see FIG. 7) where the moving electrode 21M is fitted only on the longer (right) fixed electrode 21R. A connecting member 27 is mounted on the outer periphery of the moving electrode 21M, connecting shafts 28 are formed on and project from the connecting member 27, and the connecting member 27 is connected to the lever 35 by the connecting shafts 28 (see FIG. 5).

Lower end portions of two arms 36 of the lever 35 (described later) are received respectively in the lever support spaces 15. A lower surface of each of the lever support spaces 15 serves as a guide surface 29 parallel to the direction of connection and disconnection of the electrode unit 20. The lower end of each arm 36 is disposed in sliding contact with the associated guide surface 29 so as to slide therealong. Arcuate stoppers 30L and 30R are formed at and extend upwardly respectively from opposite (right and left) ends of the guide surface 29 in smooth, continuous relation thereto. Inwardly overhung switching fulcrums 31L and 31R are formed respectively at upper ends of the arcuate stoppers 30L and 30R. A fixed spring retaining portion 32 is formed at a central portion of each guide surface 29 in the right-left direction. A hook 34L, formed at a lower end of a tension coil spring 33 (i.e., spring member that is a constituent element of the present invention) is retained on this fixed spring retaining portion 32. A hook 34U at the upper end of the tension coil spring 33 is retained on the arm 36 of the lever 35 (to be described later).

The lever 35 is made of a synthetic resin, and has a handle portion 37 extending between the pair of arms 36, so that the lever 35 has a gate-like configuration as a whole. The lever 35 is provided astride the electrode unit 20, and the lower end portions of the two arms 36 are received respectively in the lever support spaces 15 (see FIG. 5). A slot 38 is formed through that portion of each arm 36 disposed generally centrally of the length thereof, and the connecting shaft 28 of the moving electrode 21M is fitted in the slot 38 so as to be displaced relative thereto. A movable spring retaining portion 39 is formed on that portion of the arm 36 disposed below the slot 38, and the hook 34U at the upper end of the tension coil spring 33 is engaged with this spring retaining portion 39. The arcuate (or generally semi-circular) lower end of each of the two arms 36 serves as a pivot 36A about which the lever 35 can be tilted. This arcuate lower end can smoothly slide over the guide surface 29 in the right-left direction intersecting the direction of extension and contraction of the tension coil spring 33.

Figure 3:
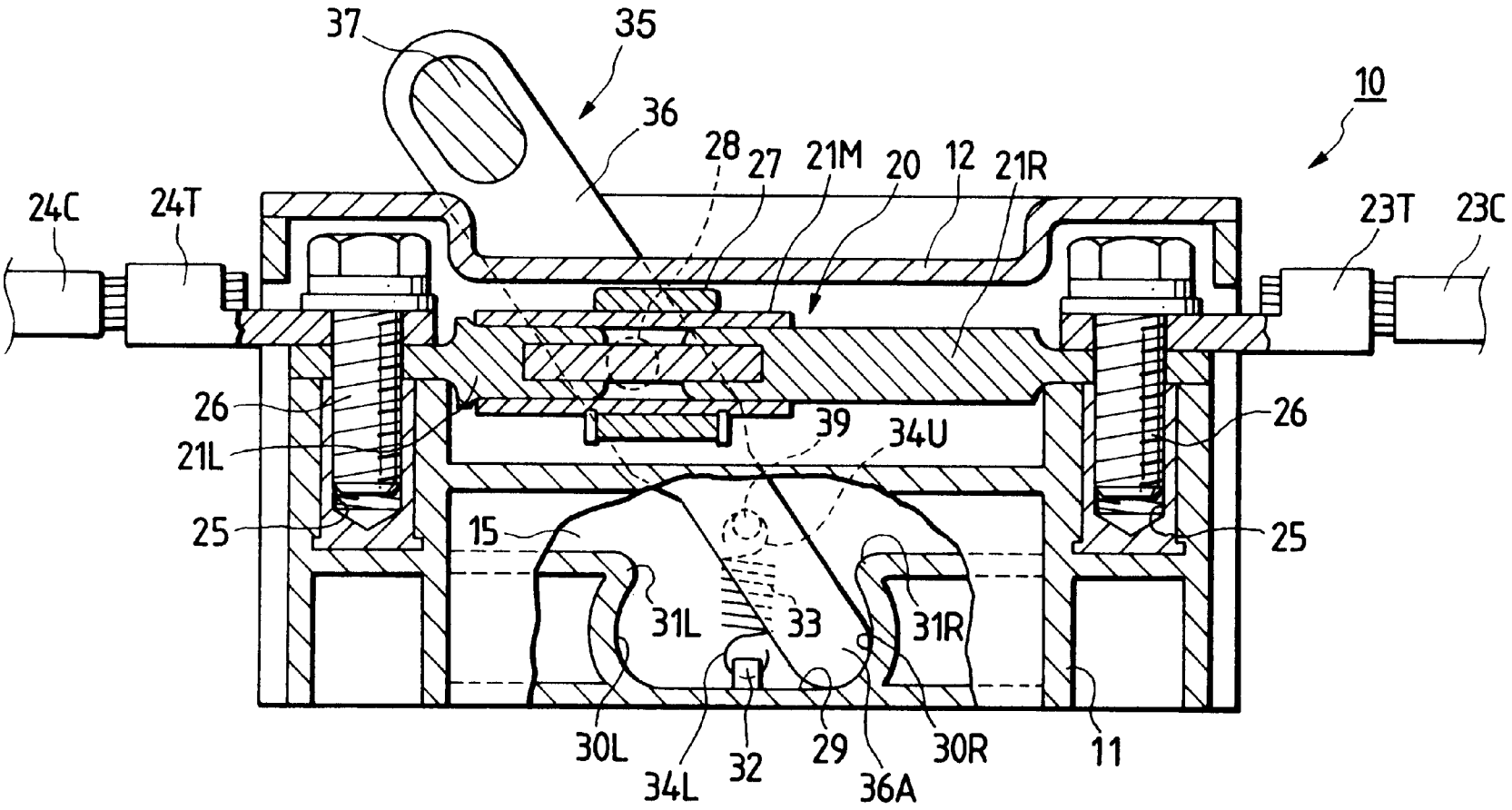
FIG. 3 is a vertical cross-sectional view of a breaker device according to a first embodiment, showing a lever in a connected position.
Figure 4:
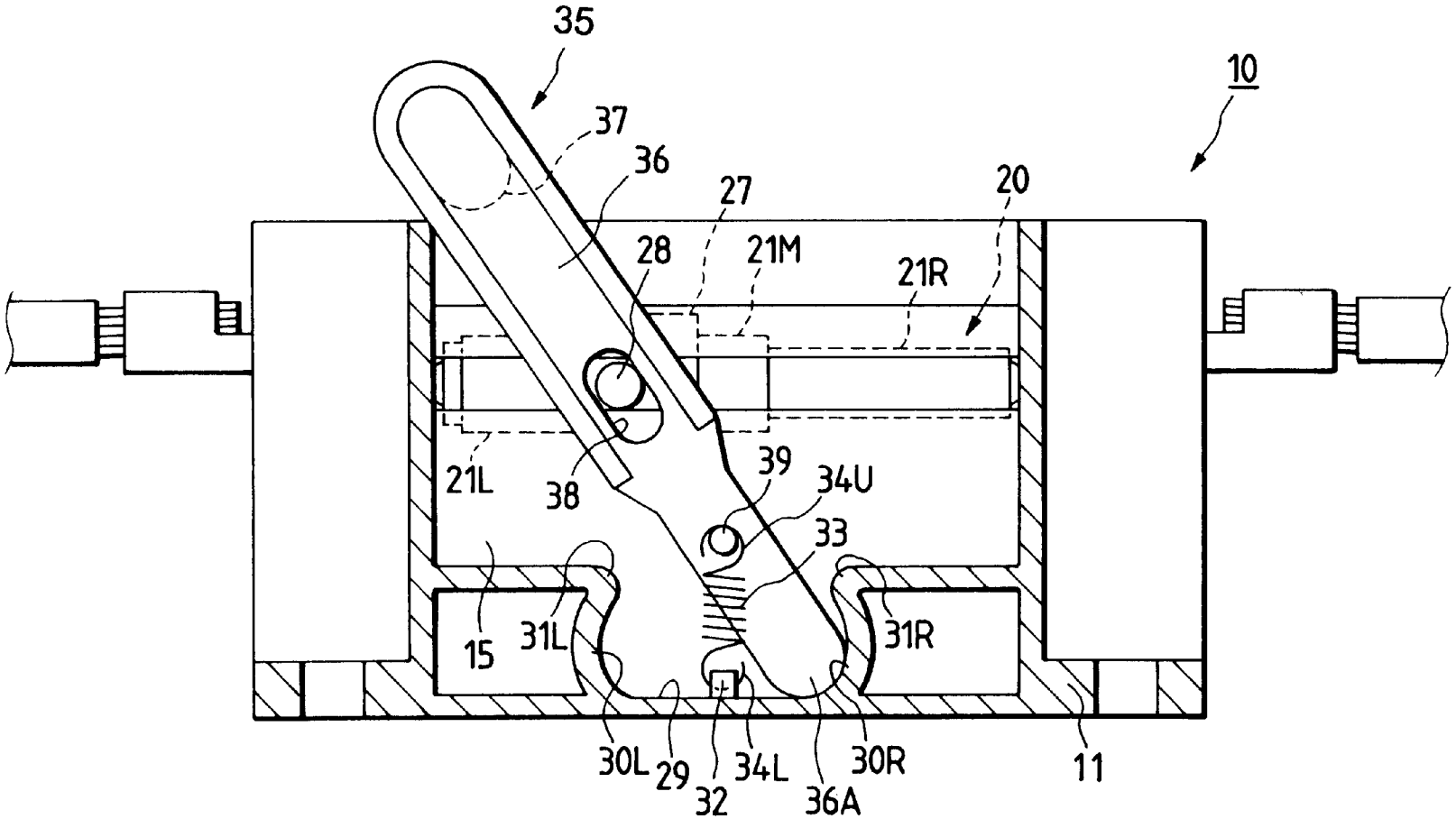
FIG. 4 is a partly broken, side-elevational view of the breaker device of the first embodiment, showing the lever in the connected position.
Figure 5:
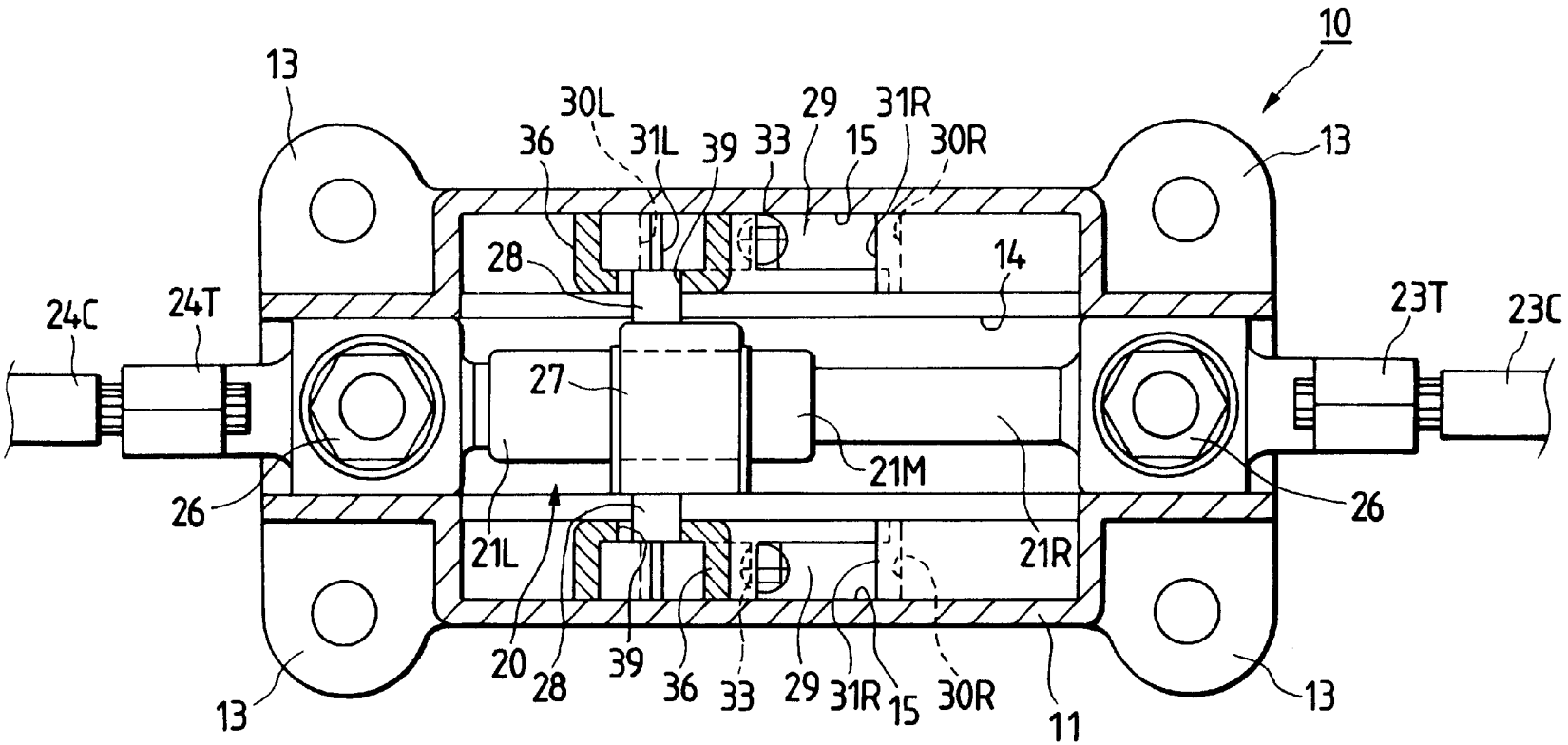
FIG. 5 is a horizontal cross-sectional view of the breaker device of the first embodiment, showing the lever in the connected position.
Figure 6:
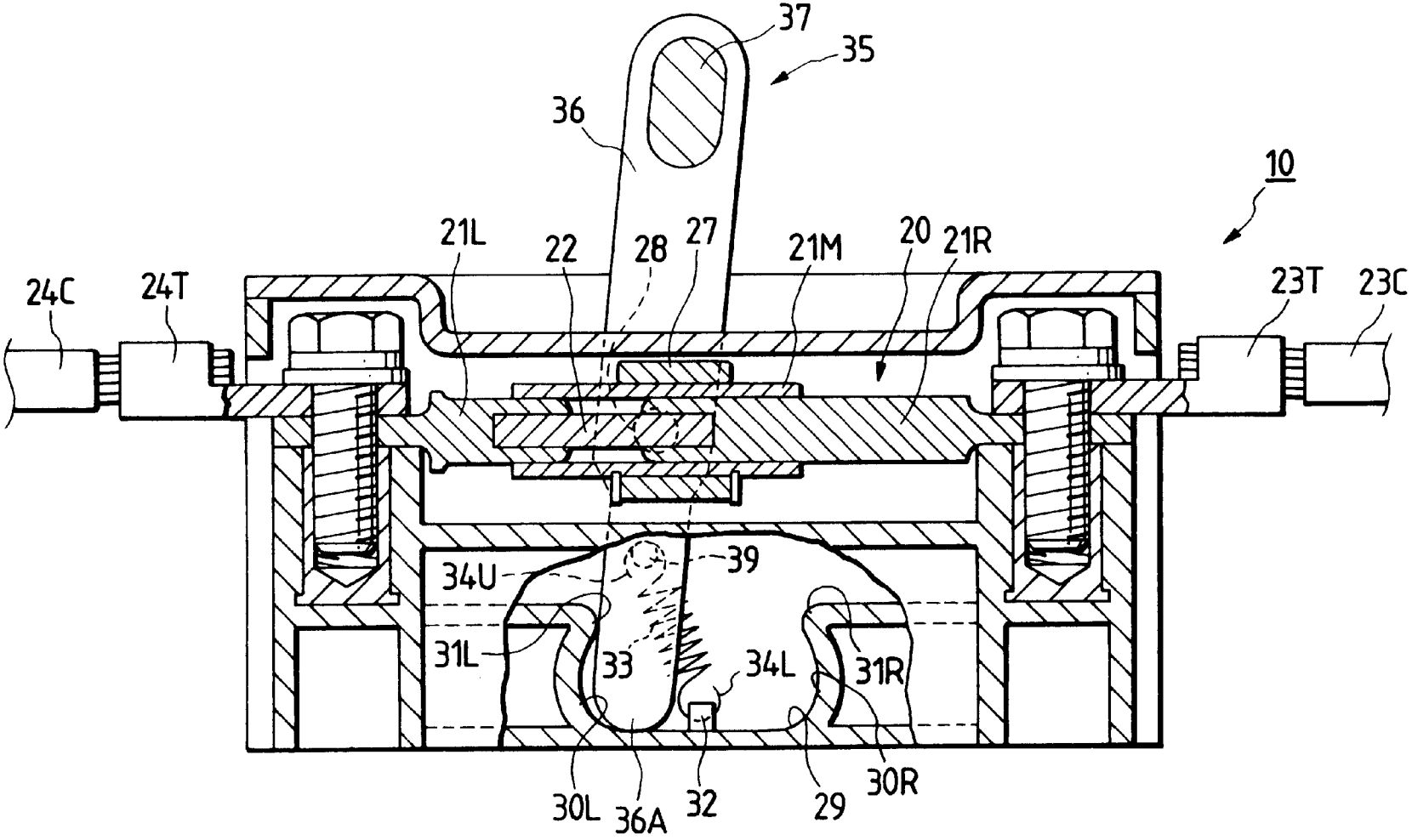
FIG. 6 is a vertical cross-sectional view of the breaker device of the first embodiment, showing the process of tilting the lever from a disconnected position to the connected position.
Figure 7:
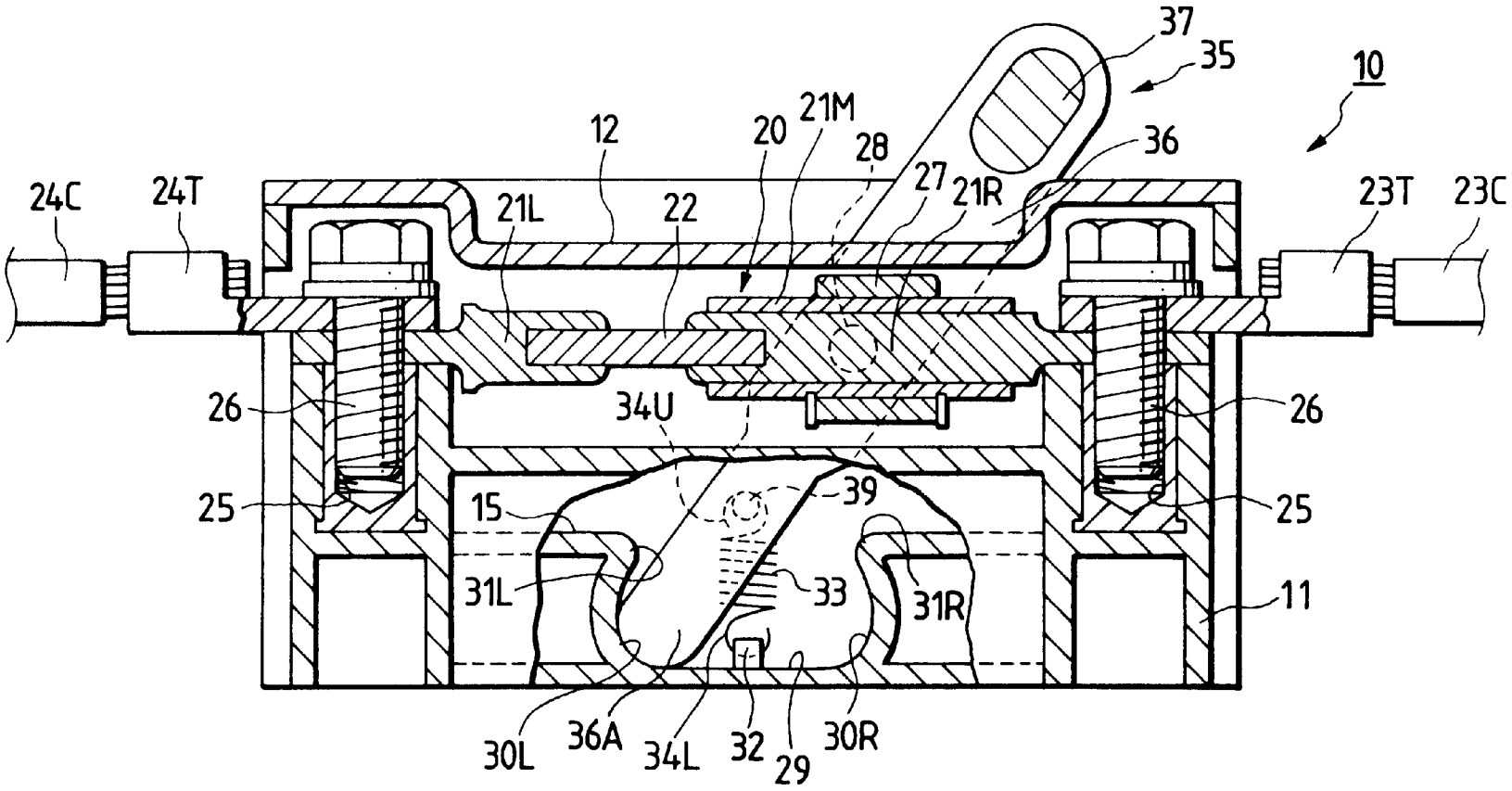
FIG. 7 is a vertical cross-sectional view of the breaker device of the first embodiment, showing the lever in the disconnected position.
Figure 8:
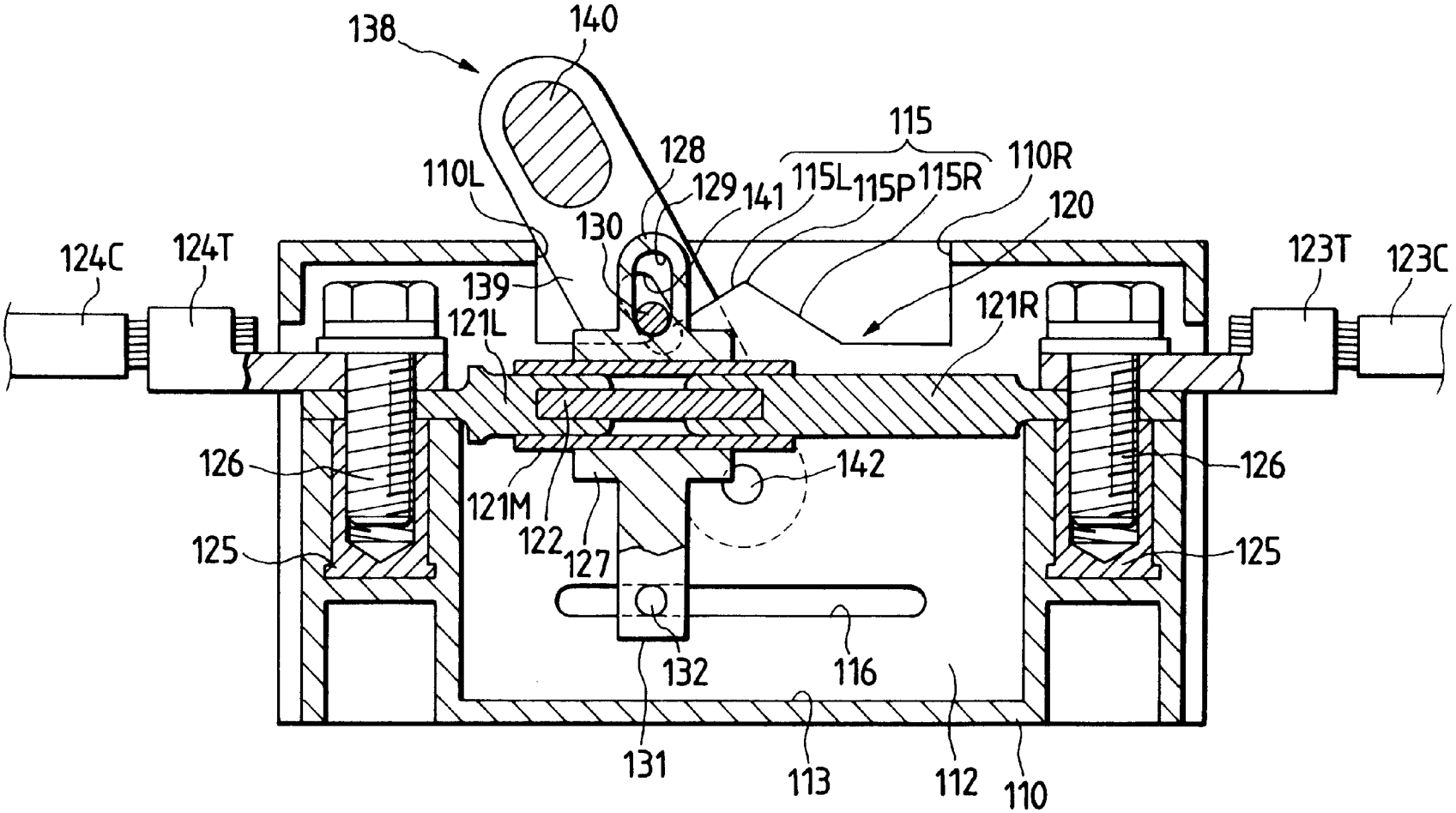
FIG. 8 is a vertical cross-sectional view of a breaker device according to a second embodiment, showing a connected condition.
Figure 9:
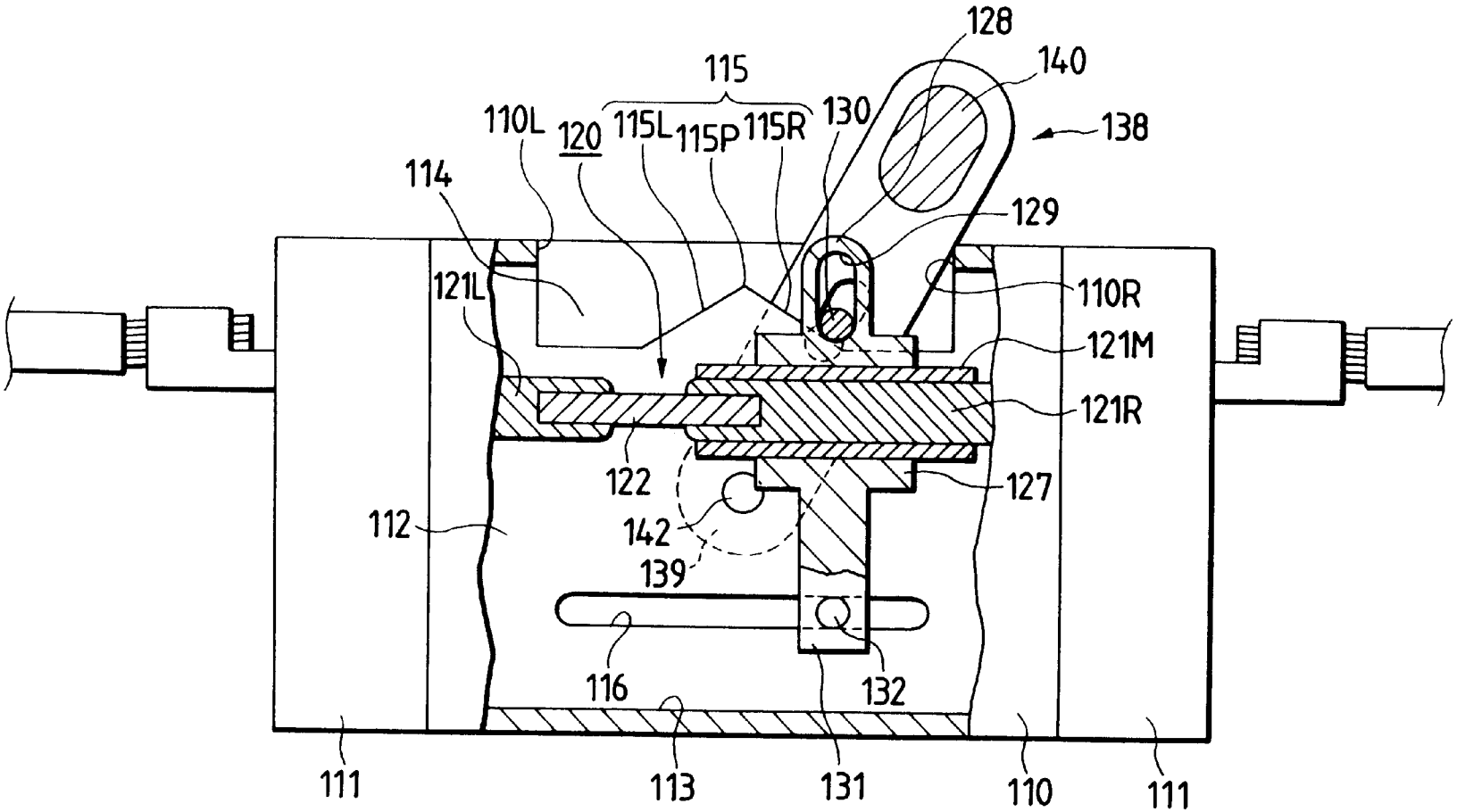
FIG. 9 is a partly broken, side-elevational view of the breaker device of the second embodiment, showing the connected condition.
Figure 10:
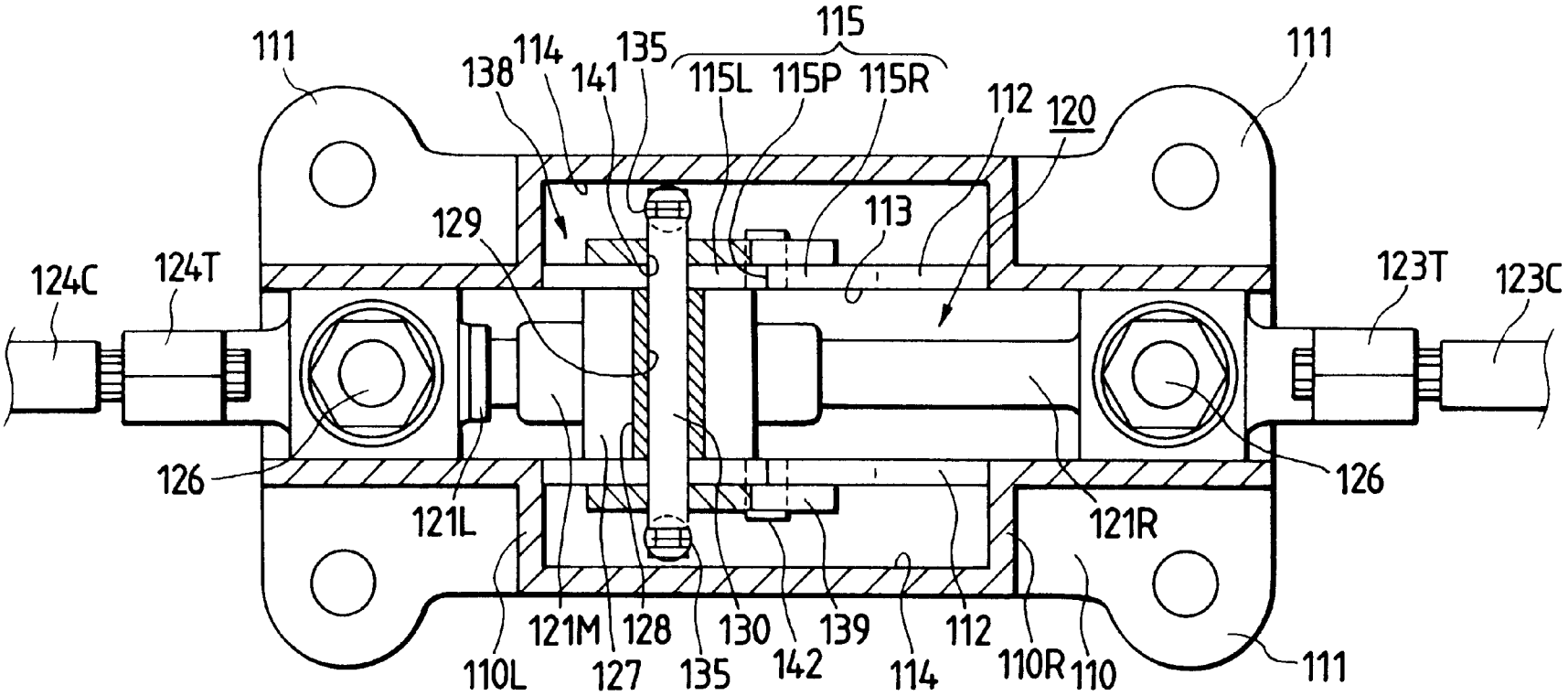
FIG. 10 is a horizontal cross-sectional view of the breaker device of the second embodiment, showing the connected condition.
Figure 11:
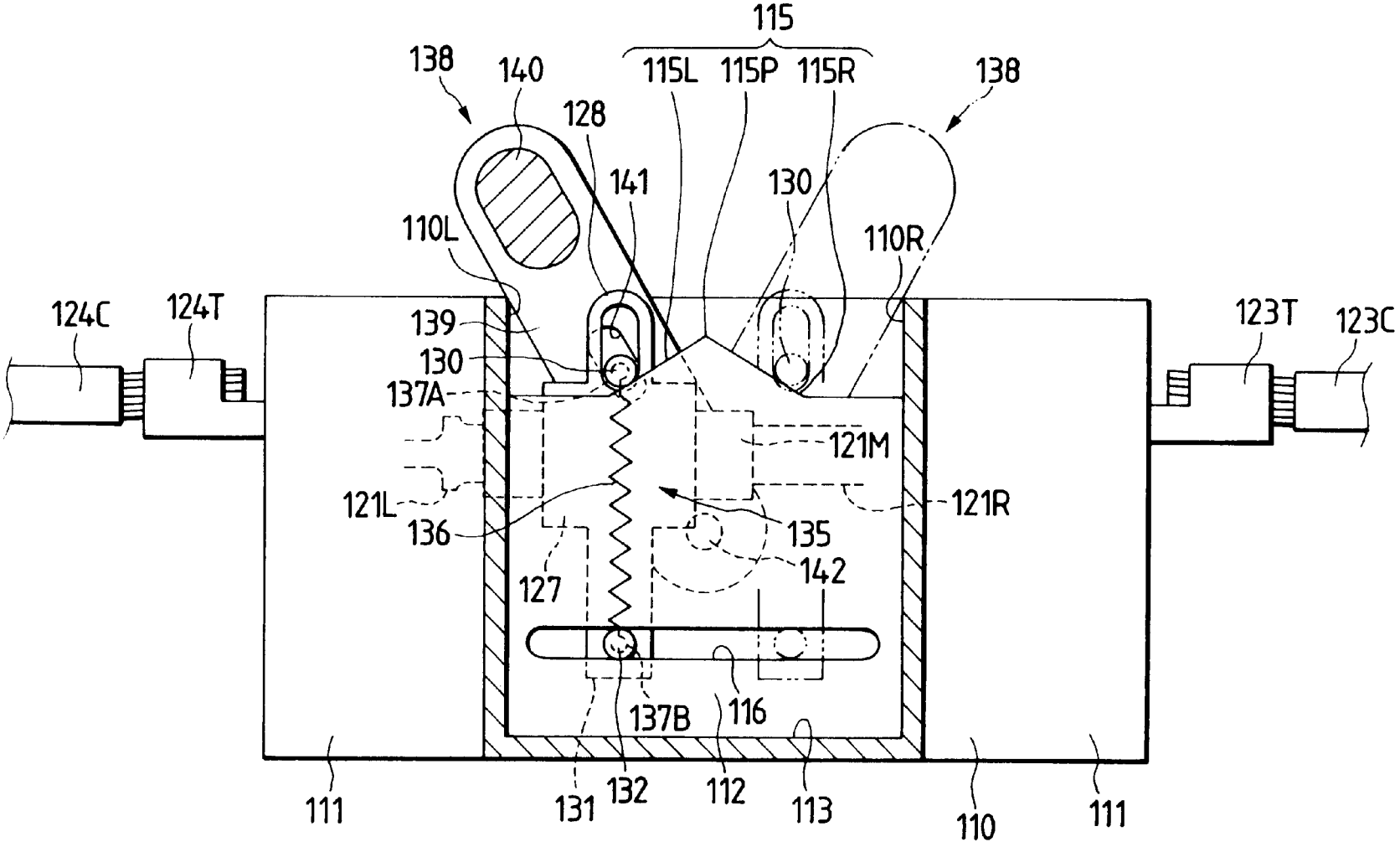
FIG. 11 is a partly-broken, side-elevational view of the breaker device of the second embodiment, showing the connected condition and the disconnected condition.
Figure 12:
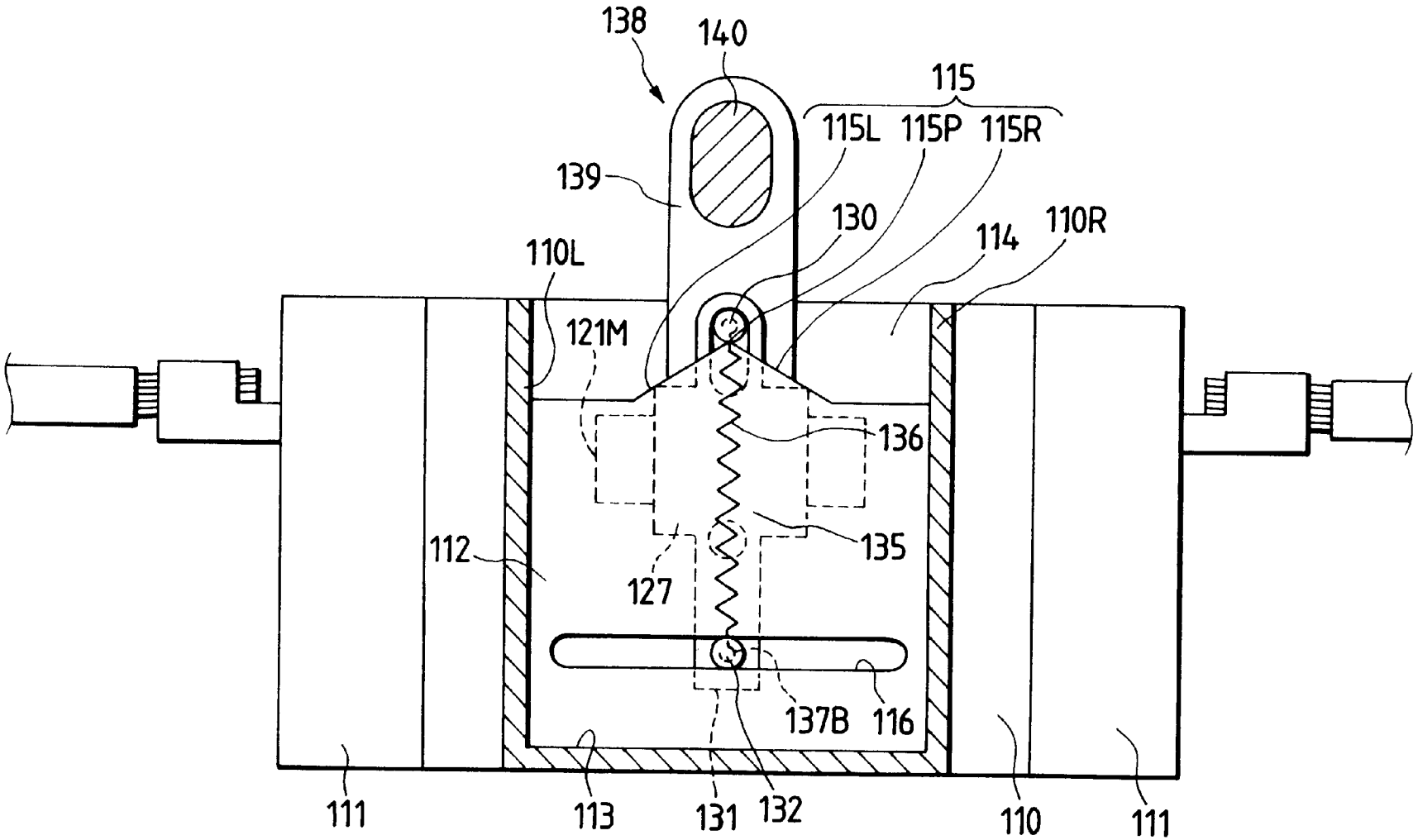
FIG. 12 is a partly broken, side-elevational view of the breaker device of the second embodiment, showing a neutral condition.

With this construction, the tilting movement of the lever 35 is converted into the sliding movement of the moving electrode 21M. More specifically, when the lever 35 is fully tilted left into the connected position, with the tilting pivot 36A at the lower end of each arm 36 engaged with the right arcuate stopper 30R, the moving electrode 21M is slid left to fit on the two fixed electrodes 21L and 21R to interconnect them, thereby electrically connecting the two fixed electrodes 21L and 21R together, as shown in FIG. 3. On the other hand, when the lever 35 is fully tilted right into the disconnected position, with the tilting pivot 36A of each arm 36 engaged with the left arcuate stopper 30L, the moving electrode 21M fits only on the right fixed electrode 21R, thereby interrupting the electrical connection between the two fixed electrodes 21L and 21R, as shown in FIG. 7.

When the lever 35 is fully tilted in the connected position or the disconnected position, the tension coil spring 33 is in a free condition in that it is substantially not resiliently extended. When the lever 35 is between the connected position and the disconnected position, the tilting pivot 36A is closer to the fixed spring retaining portion 32, and also the movable spring retaining portion 39 is spaced upwardly away from the guide surface 29. As a result, the tension coil spring 33 is resiliently extended, and a resilient restoring force of the tension coil spring 33 urges the lever 35 in either the connecting direction or the disconnecting direction.

Whether the urging direction of the tension coil spring 33 is the connecting direction or the disconnecting direction is determined by the position of the tilting pivot 36A of the lever 35 relative to the fixed spring retaining portion 32 and by the angle of the arm 36 relative to the guide surface 29. Namely, when the tilting pivot 36A is disposed on the right side of the fixed spring retaining portion 32, and also the arm 36 is tilted left from a plane perpendicular to the guide surface 29 as shown in FIG. 3, the urging direction is the direction for tilting the lever 35 leftward. However, when the arm 36 is tilted right from the above perpendicular plane even though the tilting pivot 36A is disposed on the right side of the fixed spring retaining portion 32, the urging direction is switched to the disconnecting direction so as to tilt the lever 35 right. When the tilting pivot 36A is disposed on the left side of the fixed spring retaining portion 32, the operation is reverse to the above operation with respect to the left and right directions, and therefore explanation thereof will be omitted. In a condition in which the tilting pivot 36A is disposed at the same position as that of the fixed spring retaining portion 32, when the lever 35 is tilted right or left from the neutral position perpendicular to the guide surface 29, the urging force is exerted in this tilting direction.

Next, the operation of this embodiment will be described.

When the lever 35 is disposed in the disconnected position (FIG. 7) to electrically disconnect the two fixed electrodes 21L and 21R from each other, the degree of tilting of the lever 35 is at a maximum. That is, the angle of inclination of this lever relative to each guide surface 29 is at a minimum. Further, the tilting pivot 36A is engaged with the left arcuate stopper 30L, and also each connecting shaft 28 is retainingly engaged with the upper end of the slot 38, thereby preventing the lever 35 from being further tilted. Each of the tension coil springs 33 are in a free condition (i.e., a most contracted condition), and therefore no urging force acts on the lever 35. But when trying to move the lever 35 toward its upright position, the tension coil springs 33 are resiliently extended, so that the urging force, acting in the tilting direction, is applied to the lever 35, and therefore the lever 35 is held in the disconnected position.

In this condition, for connecting the two fixed electrodes 21L and 21R together, the handle portion 37 is gripped, and then the lever 35 is turned or tilted about the tilting pivot 36A in a counterclockwise direction (FIG. 7). The tilting movement is thus started, and then that portion of each arm 36, disposed above the tilting pivot 36A, abuts against the switching fulcrum 31L (see FIG. 6) before the arm 36 is brought into the position where it is perpendicular to the guide surface 29, and thereafter the lever 35 is tilted about these switching fulcrums 31L. During this tilting operation, the tension springs 33 are resiliently extended, and therefore because of the resilient restoring force of these springs, the urging force, tending to return the lever 35 to the disconnected position, acts on the lever 35. Therefore, if the operation of the lever 35 is interrupted during a non-connected condition or an incompletely connected condition, the lever 35 is returned to the disconnected position under the influence (bias) of the tension coil springs 33.

When the tilting of the lever 35 proceeds such that each arm 36 passes past the position where it is perpendicular to the guide surface 29, the direction of urging by each tension coil spring 33 is switched from the disconnecting direction to the connecting direction. Each tilting pivot 36A of the lever 35 is slidingly moved over the guide surface 29 in the right-hand direction (of the drawings), and the lever 35 is tilted in the counterclockwise direction with a side surface of each arm 36 held in sliding contact with the switching fulcrum 31L. Then, finally, the lever 35 is brought into the connected position (FIG. 3) where each tilting pivot 36A of the lever 35 is engaged with the right arcuate stopper 30R, and each connecting shaft 28 is retainingly engaged with the upper end of the slot 38. In this condition, the moving electrode 21M is fitted on the left and right fixed electrodes 21L and 21R to interconnect them, and therefore the two fixed electrodes 21L and 21R are electrically connected together.

In this connected condition, each tension coil spring 33 is in the free condition, and does not exert any urging force on the lever 35, as in the disconnected condition. However, when trying to move the lever 35 toward its upright position, the tension coil springs 33 are extended, so that the urging force acts on the lever 35, and therefore the lever 35 is held in the connected position.

The operation for switching this device from the connected condition to the disconnected condition is effected in a right-left symmetrical manner for the above operation for switching this device from the disconnected condition to the connected condition, and therefore explanation thereof will be omitted.

As described above, in this embodiment, the lever 35 can be urged in either of the connecting direction and the disconnecting direction by the tension coil springs 33. Therefore, the two fixed electrodes 21L and 21R are prevented from being held in an incompletely-connected condition, and can be held in either of the completely-connected condition and the completely-disconnected condition.

The amount of resilient deformation of each tension coil spring 33 becomes maximum halfway during the connecting operation and the disconnecting operation when the direction of urging by this spring is switched between the disconnecting direction and the connecting direction. On the other hand, each tension coil spring 33 is in the free condition in which it is not resiliently deformed at all when in the connected condition (i.e., when the two fixed electrodes 21L and 21R are properly connected together), or in the disconnected condition (i.e., when the two fixed electrodes are completely disconnected from each other). Therefore, even if the two fixed electrodes 21L and 21R are held in the connected condition or the disconnected condition for a long period of time, the tension coil springs 33 are positively prevented from being subjected to a permanent set in fatigue. Also, a creep due to the urging by the tension coil springs 33 is positively prevented from developing in the lever 35 and the casing 10.

Additionally, each tilting pivot 36A of the lever 35 is not fixed relative to the casing 10, but can move along the guide surface 29 parallel to the direction of sliding of the moving electrode 21M (i.e., the direction of connection and disconnection of the fixed electrodes 21L and 21R). Therefore as compared with a construction in which a lever is tilted about a fixed pivot, the lever 35 is tilted at a larger angle in the connected position and the disconnected position. Namely, the angle of inclination of the lever 35 relative to each guide surface 29 is smaller, and therefore the height of the lever 35 is reduced, and the overall height of the breaker device is reduced.

The present invention is not limited to the embodiment described above with reference to the drawings, as various modifications can be made thereto without departing from the scope of the invention. For example, the following embodiments fall within the technical scope of the present invention.

In the above embodiment, although tension coil springs 33 are used as the spring members, other springs may be used, such as torsion coil springs, compression coil springs, leaf springs and linear springs.

In the above embodiment, although each tilting pivot 36A of the lever 35 is displaceable, the lever may alternatively be tilted about a fixed pivot.

In the above embodiment, there may be used an arrangement in which rollers may be provided at the lower end of the lever 35, in which case the rollers roll respectively over the guide surfaces 29 in accordance with the tilting movement of the lever. With this construction, the friction between the lever and each guide surface is greatly reduced, and therefore the operability of the lever is enhanced.

In the above embodiment, the tension coil springs 33 are not resiliently deformed at all when the lever 35 is in the connected position and the disconnected position. However, in the present invention, there may be used an arrangement in which the tension coil springs 33 are resiliently deformed when the lever 35 in the connected position and the disconnected position. With this construction, the reliability of the function of holding the lever in the connected position and the disconnected position is enhanced.

[Second Embodiment]

A preferred embodiment of the present invention will now be described with reference to FIGS. 8 to 12.

A breaker device of this embodiment is provided for opening and closing a main power circuit connecting a battery (not shown) to various electronic equipment in an electric car. An electrode unit 120, which is received in a casing 110 of a synthetic resin, is brought into a fitted condition and a disengaged condition by pivotally moving a lever 138.

The casing 110 has a box-shape, and is fixedly mounted in a vehicle body of the electric car through mounting portions 111 (see FIG. 10) provided respectively at four corner portions of the casing 110. The interior of the casing 110 is divided into three chambers by two partition walls 112 (see FIG. 10). The intermediate chamber serves as an electrode receiving space 113 for receiving the electrode unit 120, and the front and rear chambers serve as lever support spaces 114 for receiving the lever 138.

An upper edge of each of the two partition walls 112 is formed into a guide 115. When viewed from the top, the guide 115 is parallel to a path of movement of a moving electrode (described later) from a connected position to a disconnected position (see FIG. 10). When viewed from the front side, on the other hand, the guide 115 has a mountain-like shape having a peak at a position 115P disposed midway along the direction of the path of movement of the moving electrode 121M (see FIGS. 11 and 12). That slope of the guide 115, slanting downwardly in the left-hand direction, serves as a connection-side slanting surface 115L while that slope, slanting downwardly in the right-hand direction, serves as a disconnection-side slanting surface 115R. A movable pin 130, mounted on the moving electrode 121M (described later), can slide over the guides 115. A slit 116 is formed through a lower portion of each of the two partition walls 112, and extends parallel to the path of movement of the moving electrode 121M as viewed from the front side (see FIGS. 11 and 12). Fixed pins 132, mounted on the moving electrode 121M, are passed respectively through the slits 116, and are slidable therealong.

The electrode unit 120 includes a pair of left and right fixed electrodes 121L and 121R one of which is longer than the other, and the moving electrode 121M slidably fitted on the outer peripheries of these fixed electrodes. The two fixed electrodes 121L and 21R are each in the form of a round rod, and their distal ends are opposed to each other. The two fixed electrodes 121L and 121R are interconnected by a connecting rod 122 made of a non-electrically-conductive synthetic resin, and therefore are integrally connected together, and are insulatingly spaced a predetermined distance from each other on a common axis extending in a right-left direction. The fixed electrode 121L, together with a connection terminal 124T (connected to an electric equipment-side cable 124C) is fixedly secured by a bolt 126 to a nut 125 that is insert-molded in the casing 110. The fixed electrode 121R, together with a connection terminal 123T (connected to a battery-side cable 123C) is fixedly secured by a bolt 126 to a nut 125 that is insert-molded in the casing 110.

The moving electrode 121M has a cylindrical shape so that it can fit on the two fixed electrodes 121L and 121R, and a louver contact (not shown) is mounted on an inner peripheral surface of the moving electrode 121M. The moving electrode 121M is slidable between a connected position (see FIG. 8) where it is fitted on the two fixed electrodes 121L and 121R to interconnect them and a disconnected position (see FIG. 9) where the moving electrode 121M is fitted only on the longer (right) fixed electrode 121R.

A connecting member 127 having a square shape is mounted integrally on the outer periphery of the moving electrode 121M for movement therewith, and a pin-receiving portion 128 is formed on and projects upwardly from the connecting member 127. A slot 129 is formed through this pin-receiving portion 128, and is elongate in an upward-downward direction as viewed from the front side. The movable pin 130 having a round cross-section is fitted in the slot 129 for upward and downward movement therealong. Namely, the movable pin 130, while moving upward and downward relative to the moving electrode 121M, moves together with the moving electrode 121M in the disconnecting direction. Opposite end portions of the movable pin 130, projecting from the slot 129, slide respectively over the guides 115. Those portions of the movable pin 130, disposed outwardly respectively of the guides 115, extend respectively through holes 141 formed in the lever 138. Upper hooks 137A of tension coil springs 135 (i.e., spring members that are constituent elements of the present invention) are retainingly engaged respectively with those portions of the movable pin 130 disposed outwardly respectively of the lever 138.

A pin support portion 131 is formed on and projects downwardly from the connecting member 127, and the pair of front and rear fixed pins 132 are formed on this pin support portion 131. The fixed pins 132 extend respectively through the slits 116 as described above, and lower hooks 137B of the tension coil springs 135 are retainingly engaged respectively with the projected ends of the fixed pins 132.

The tension coil spring 135 is a well-known spring, and has the upper hook 137A and the lower hook 137B formed integrally at its respective upper and lower ends. As described above, the upper hook 137A is engaged with the movable pin 130 while the lower hook 137B is engaged with the fixed pin 132, and a coil portion 136 of each tension coil spring 135 is always resiliently extended.

The lever 138 is made of a synthetic resin, and has a handle portion 140 extending between a pair of arms 139, so that the lever 138 has a gate-like configuration as a whole. The lever 138 is provided astride the electrode unit 120, and the lower end portions of the two arms 139 are received respectively in the lever support spaces 114 (see FIG. 10). Shafts 142 at the lower end portions of the two arms 139 pivotally support the lever 138. A slot 141 is formed through that portion of each arm 139 disposed generally centrally of the length thereof, and the movable pin 130 extends through this slot 141.

Next, the operation of this embodiment will be described.

When the lever 138 is disposed in the disconnected position (FIG. 9) to electrically disconnect the two fixed electrodes 121L and 121R from each other, the movable pin 130 is engaged with a lower portion of the disconnection-side slanting surface 115R of each of the guides 115, and also the fixed pins 132 are disposed substantially beneath the movable pin 130. In this condition, the movable pin 130 and the fixed pins 132 are urged by the resilient restoring forces of the tension coil springs 135 in the disconnecting direction to decrease the distance between each guide 115 and the slit 116 (i.e., the distance between the movable pin 130 and the fixed pin 132). The movable pin 130 presses the moving electrode 121M, and therefore the moving electrode 121M is also urged in the disconnecting direction by the tension coil springs 135. However, the lever 138, with which the movable pin 130 is engaged, is abutted against disconnection-side stoppers 110R of the casing 110, and is prevented from being further tilted in the disconnecting direction (clockwise direction in FIG. 9). Therefore, the moving electrode 121M can not further move in the disconnecting direction, and the electrode unit 120 is held in the predetermined disconnected condition against the bias of the tension coil springs 135.

For switching the electrode unit 120 from this disconnected condition to the connected condition, the lever 138 is pulled and pivotally moved in a counterclockwise direction (FIG. 9) against the bias of the tension coil springs 135. As a result, the movable pin 130, engaged in the slots 141 in the lever 138, is moved in the connecting direction, and the moving electrode 121, engaged with the moving pin 130 and the fixed pins 132, is also moved in the connecting direction. During this operation, the movable pin 130 slides upwardly over the disconnection-side slanting surfaces 115R of the guides 115, and therefore the distance between the movable pin 130 and each fixed pin 132 increases, so that the tension coil springs 135 are extended. Namely, the urging force applied in the disconnecting direction by the tension coil springs 135, increases. Therefore, if the pivotal movement of the lever 38 is interrupted when the movable pin 130 is disposed on the disconnection-side slanting surfaces 115R, the lever 138 and the moving electrode 121M are returned to the disconnected position by the bias of the tension coil springs 135.

When the pivotal movement of the lever 138 is continued against the bias of the tension coil springs 135, the movable pin 130 reaches the peaks 115P of the guides 115. Then, when the pivotal movement is further continued, the movable pin 130 is brought into sliding contact with the connection-side slanting surfaces 115L, and therefore the direction of urging by the tension coil springs 135 is switched from the disconnecting direction to the connecting direction. Therefore, when releasing the lever 138 in this condition in which the movable pin 130 has moved past these peaks, the lever 138 and the moving electrode 121M are automatically moved in the connecting direction by the bias of the tension coil springs 135. Then, the lever 138 abuts against the connection-side stoppers 110L, and is prevented from being further tilted, so that the electrode unit 120 is held in the properly connected condition.

In this connected condition, the coil portions 136 of the tension coil springs 135 are kept resiliently extended as in the disconnected condition, and therefore the urging force, acting in the connecting direction, is kept applied to the moving electrode 121M. Therefore, if a force, acting on the lever 138 to pivotally move the same in the disconnecting direction, is smaller than the urging force, the moving electrode 121M is held in the connected position.

An operation for switching the electrode unit from the connected condition to the disconnected condition is similar to the above operation for switching the electrode unit from the disconnected condition to the connected condition, and therefore explanation thereof will be omitted.

As described above, the direction of urging by the tension coil springs 135 is switched between the connecting direction and the disconnecting direction midway along the path of movement of the moving electrode 121M. Therefore, the two fixed electrodes 121L and 121R are prevented from being held in an incompletely-connected condition, and the two fixed electrodes are held in either of the completely-connected condition and the completely-disconnected condition.

The urging force becomes maximum at the position where the direction of this urging force is switched. The urging force of the tension coil springs 135 is decreased when the moving electrode 121M is located in the properly-connected position or the predetermined disconnected position. Therefore, in the case where a lock means (though not provided in this embodiment) is provided for holding the moving electrode 121M in the connected position or the disconnected position, it is not necessary to increase the strength and size of this lock means.

Even if the locking is accidentally released by vibrations, an impact or the like in the case where a means is provided for locking the moving electrode 121M in the connected condition, the moving electrode 121M is prevented from being moved in the disconnecting direction.

Since the urging force of the tension coil springs 135 is decreased, even if the connected condition or the disconnected condition of the two fixed electrodes lasts a long time, the tension coil springs 135 are positively prevented from being subjected to a permanent set in fatigue. Also, a creep due to the urging by the tension coil springs 135 is positively prevented from developing in the lever 138 and the casing 110.

Furthermore, the moving electrode 121M is kept urged in the connecting direction even in the connected condition. Therefore, even if a small external force, acting in the disconnecting direction, is applied to the lever 138 and the moving electrode 121M, the moving electrode 121M is held in the connected condition, thus achieving high connection reliability.

Further, each of the spring members comprises the tension coil spring 135, and therefore the spring members will not be buckled in contrast with the case where the spring member comprise a compression coil spring. Namely, the function of urging the moving electrode 121M is highly reliable.

The present invention is not limited to the embodiment described above with reference to the drawings, and various modifications can be made thereto without departing from the scope of the invention. For example, the following embodiments fall within the technical scope of the present invention.

In the above embodiment, although the tension coil springs are used as the spring members, compression coil springs or torsion coil springs may alternatively be used. In the case of the compression coil springs, each of the guides is formed into an inverted mountain-like shape. In the case of the torsion coil springs, either of a mountain-like shape and a valley-like shape may be used by changing the direction of the terminals. Spring members other than the compression coil springs and torsion coil springs, such as leaf springs and linear springs, may also be used.

In the above embodiment, although the lever can be tilted separately from the moving electrode, the lever may be mounted integrally with the moving electrode in the present invention, so that the lever can be moved in a parallel manner.

In the above embodiment, there may also be provided a lock means for holding the moving electrode in the connected position.

In the above embodiment, although the pin, engaged with the tension coil springs, is slid over the guides, there may be used an arrangement in which rollers are provided on the pin so as to roll respectively over the guides. With this construction, the resistance is greatly reduced, and therefore the reliability of the moving operation is enhanced.

In the above embodiment, the movable pin is separate from the moving electrode, and the fixed pins are integral with the moving electrode. However, in the present invention, the movable pin and the fixed pins may be separate from the moving electrode so that they can move upward and downward relative to the moving electrode. In this case, two pair of upper and lower guides are provided, and these guides have a configuration defined by a combination of straight lines and a mountain-like contour or a valley-like contour.

In the above embodiment, the position where the resilient restoring force (i.e., urging force) of the tension coil springs is maximum is the position disposed midway along the path of movement of the moving electrode. However, in the present invention, the position where the resilient restoring force is at a maximum may be offset from the midway position in the connecting direction or the disconnecting direction.

What is claimed is:

1. A breaker device comprising:

a pair of fixed electrodes;

a tiltingly displaceable lever that linearly reciprocates a movable electrode in a direction parallel to a direction between the pair of fixed electrodes so as to connect and disconnect the pair of fixed electrodes from each other; and a spring member that urges said lever in a disconnecting direction when the pair of electrodes are in an incompletely-connected condition;

wherein when an operation for connecting the pair of electrodes together proceeds to a predetermined degree, the direction of urging of said lever by said spring member is switched from the disconnecting direction to a connecting direction, and also the urging force of said spring member is decreased in accordance with the tilting displacement of said lever in the connecting direction.

2. A breaker device according to claim 1, wherein a tilting pivot of said lever is displaceable in the directions of connection and disconnection of the electrodes.

3. A breaker device according to claim 2, wherein when said lever is located at one of a starting end and a finishing end of the tilting displacement thereof, said spring member is not resiliently deformed.

4. A breaker device according to claim 1, wherein when said lever is located at one of a starting end and a finishing end of the tilting displacement thereof, said spring member is not resiliently deformed.

5. A breaker device according to claim 1, wherein the pair of fixed electrodes are connected by an electrically non-conductive member.

6. A breaker device according to claim 1, wherein one end of the spring member is substantially fixed relative to the casing body.

7. A breaker device comprising:

a fixed electrode;

a movable electrode movable along a linear path in connecting and disconnecting directions relative to said fixed electrode;

a guide extending in slanting relation to the directions of movement of said movable electrode; and a spring member movable in the connecting and disconnecting directions together with said movable electrode, said spring member being guided by said guide so as to be extended and contracted;

wherein a resilient restoring force of said spring member becomes maximum at a position halfway along the path of movement of said movable electrode, and using the maximum position as a border, said spring member urges said movable electrode in either of the connecting direction and the disconnecting direction.

8. A breaker device according to claim 7, wherein an urging force by said spring member is applied to said movable electrode even when said movable electrode is located at a position so as to be connected to said fixed electrode.

9. A breaker device according to claim 7, wherein said spring member comprises a tension coil spring.

10. A breaker device according to claim 8, wherein said spring member comprises a tension coil spring.

11. A breaker device according to claim 7, wherein one end of the spring member moves linearly while another end of the spring member moves non-linearly.

12. A breaker device according to claim 7, further comprising another fixed electrode, wherein the fixed electrodes are connected by an electrically non-conductive member.

13. A breaker device comprising:

a lever tiltingly displaceable so as to connect and disconnect a pair of electrodes from each other, the lever having a tilting pivot that is slidingly displaceable in a connecting direction and a disconnecting direction; and a spring member that urges said lever in the disconnecting direction when the pair of electrodes are in an incompletely-connected condition;

wherein when an operation for connecting the pair of electrodes together proceeds to a predetermined degree, the direction of urging of said lever by said spring member is switched from the disconnecting direction to the connecting direction, and also the urging force of said spring member is decreased in accordance with the tilting displacement of said lever in the connecting direction.

14. A breaker device comprising:

a pair of fixed electrodes;

a tiltingly displaceable lever that linearly reciprocates a moving electrode so as to connect and disconnect the pair of fixed electrodes from each other, a tilting pivot of said lever being displaceable in the directions of connection and disconnection of the electrodes; and a spring member that urges said lever in a disconnecting direction when the pair of electrodes are in an incompletely-connected condition;

wherein when an operation for connecting the pair of electrodes together proceeds to a predetermined degree, the direction of urging of said lever by said spring member is switched from the disconnecting direction to a connecting direction, and also the urging force of said spring member is decreased in accordance with the tilting displacement of said lever in the connecting direction.

15. A breaker device according to claim 14, wherein when said lever is located at one of a starting end and a finishing end of the tilting displacement thereof, said spring member is not resiliently deformed.

* * * * *